United States Patent [19]

Sloan et al.

[11] Patent Number: 4,612,430

[45] Date of Patent: Sep. 16, 1986

[54] ANTI-REBOUND LATCH

[75] Inventors: Dallas Sloan, Cameron, Wis.; Donald R. Venzke; Eugene Wehr, both of Cedar Rapids, Iowa

[73] Assignee: Square D Company, Palatine, Ill.

[21] Appl. No.: 684,540

[22] Filed: Dec. 21, 1984

[51] Int. Cl.[4] ..... H01H 77/10

[52] U.S. Cl. ..... 200/327; 200/325; 335/16

[58] Field of Search ..... 200/324, 325, 327, 153 G, 200/288; 335/16

[56] References Cited

U.S. PATENT DOCUMENTS

| | | | |
|---|---|---|---|
| 3,559,119 | 1/1971 | Koennecke et al. | 335/16 |
| 3,815,059 | 6/1974 | Spoelman | 335/16 |
| 4,220,934 | 9/1980 | Wafer et al. | 335/16 |

*Primary Examiner*—Stephen Marcus
*Assistant Examiner*—Renee S. Luebke
*Attorney, Agent, or Firm*—Larry I. Golden; Richard T. Guttman

[57] ABSTRACT

An anti-rebound latch having a generally U-shaped housing which defines a central blade path opening between first and second side legs. The housing supports a pivotally mounted generally crescent shaped drive-arm which includes a kicker portion at one end positioned adjacent the top of the blade path opening and a pusher portion at its opposite end. The drive-arm is operatively associated with a blade catcher carried by the first side leg which is reciprocally movable between a first position in which no part of the blade catcher extends into the opening and a second position in which the catcher extends across the opening to the second side leg. The catcher is spring biased to its first position. The opposite side leg may carry a pole face which attracts the catcher in response to the blow-open movement of a contact blade within the opening which hits the kicker portion of the drive-arm causing pivotal movement of the drive-arm which results in the pusher portion of the drive-arm sliding the catcher into the blade path opening towards the second side leg. As a result of electromagnetic forces generated, the pole face attracts the catcher toward its second position which prevents rebound movement of the blade to a closed position. The self contained module is provided with ribs on opposite side which are received in grooves provided in the circuit breaker housing to position the assembly within the circuit breaker.

15 Claims, 5 Drawing Figures

ANTI-REBOUND LATCH

BACKGROUND OF THE INVENTION

1. Field of the Invention

The present invention relates generally to latches and more specifically to a blow-open current limiting circuit breaker having an improved anti-rebound latch.

2. Description of the Prior Art

Current limiting breakers of the type described in U.S. Pat. No. 4,178,618 to Khalid include a blow-open design which facilitates opening of the contacts during the first milliseconds of an extreme overcurrent condition. The blade is accelerated to a high velocity by the increasing fault current and tends to rebound from its open position faster than the tripping response time of the circuit breaker mechanism. Accordingly, means must be provided to delay or hold the blade in the open position until the mechanism trips and supports the blades in the open position. If the blade is not held in the open position, the rebounding blade may reclose under a fault condition in which the excessive current can cause the contacts to weld together. It is also desirable to prevent restriking of arcs between the contacts to stop the current as soon as possible at maximum current level. Blow-open forces will cause current limiting within approximately 0.6 milliseconds; however, the blade, if not restrained in an open position, will immediately rebound and move toward a contact closed position far sooner than the 6 milliseconds it may take for the mechanism to open the circuit.

An electromagnetically actuated anti-rebound latch is described in U.S. Pat. No. 4,409,573 to DiMarco et al which also desribes some of the typical prior art latching mechanisms that utilize springs to bias a latch toward a contact arm to move the latch into a notch in the contact arm when the contact arm of the circuit breaker is blown open by electrodynamic forces to thereby retain the contact arm in an open position.

SUMMARY OF THE INVENTION

The present invention is an improvement in anti-rebound mechanisms for circuit breakers having blow-open capabilities. Each pole of the circuit breaker includes a contact blade which is movable between a closed position and an open position and which blows open in response to a substantial overcurrent condition. The circuit breaker also includes a trip mechanism which independently moves the contact blade from a closed to an open position. An anti-rebound module is associated with each movable contact blade to prevent the blade from rebounding and possibly reclosing as a result of the accelerated opening movement of the blade under substantial overcurrent conditions. A drop-in module is provided which floats in grooves between two pieces of rubber. The anti-rebound assembly utilizes the high velocity of the blown open contact blade to mechanically initiate closure of a blade catcher which may be further closed and held in a latched position by electromagnetic attraction.

A generally U-shaped housing is provided with a central blade path opening adapted to receive a movable contact blade. The housing includes opposite leg portions and pivotally supports a drive arm at the top of one leg portion. The drive arm includes a kicker portion which extends into the central opening and an opposite pusher portion. The movable contact blade hits the kicker portion in response to the blade being blown open which pivots the drive arm causing the pusher portion to push a blade catcher partially into the returning path of the contact blade as the blade rebounds from its fully open position. The blade catcher is spring biased by a return spring toward the pusher portion of the drive arm and ordinarily does not extend into the blade path opening. A catcher pole may be retained by the housing on the opposite leg portion across the opening from the blade catcher which causes electromagnetic attraction between the blade catcher and the catcher pole in response to the blow-open movement of the contact blade to an open position. The blade catcher prevents the contact blade from closing until the trip mechanism causes the crossbar to move upward lifting the contact blade off the blade catcher. The blade catcher then resets itself by retracting into the catcher housing under the force provided by the return spring.

An object of the present invention is to provide an anti-rebound mechanism which utilizes the acceleration of the movable contact blade to mechancally initiate closure of a reciprocally movable blade catcher member which may be further operated through the use of electromagnetic forces.

A further object of the present invention is to provide an anti-rebound module which can be readily installed.

Another object of the present invention is to provide a reliable and economical anti-rebound mechanism.

A still further object of the invention is to provide an anti-rebound mechanism which self resets.

Further objects and features of the invention will be readily apparent to those skilled in the art from the following specification including the appended claims and the accompanying drawings of the invention in which:

DETAILED DESCRIPTION OF THE PREFERRED EMBODIMENT

Figure 1:
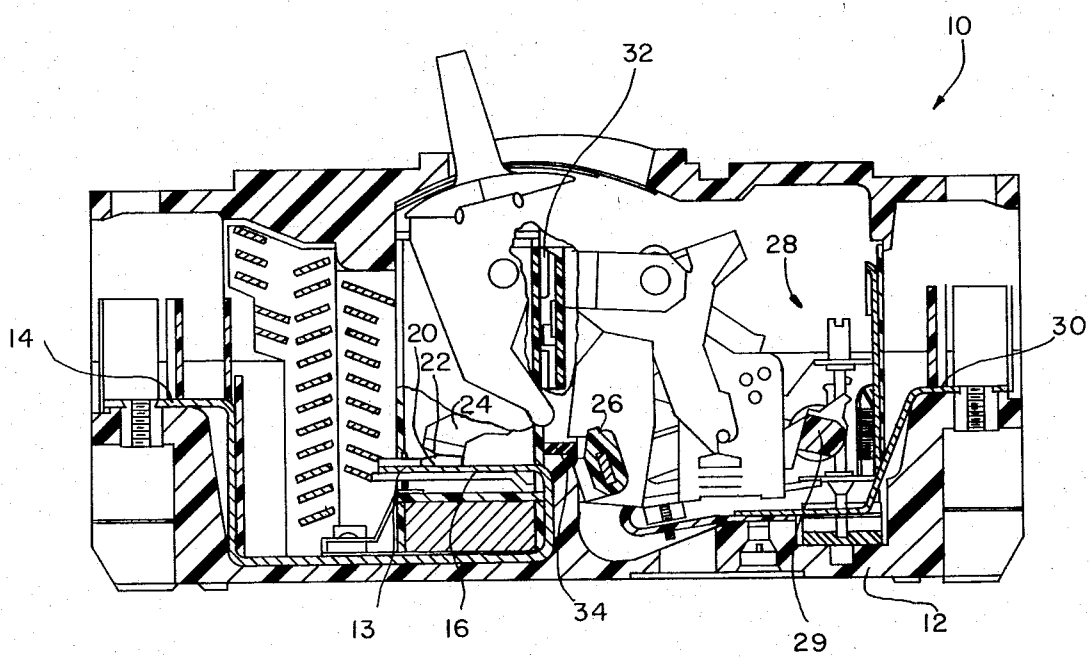
FIG. 1 is a side view of one pole of a three pole circuit breaker having blow-open contact blades and an anti-rebound mechanism of the present invention.

Referring to FIG. 1, one pole of a three pole circuit breaker identified generally as 10 is shown. The circuit breaker which is further described in Ser. No. 684,558 by Lang, Cook, Evans and Oster for Improved Current Limiting Circuit Breaker filed concurrently herewith on Dec. 21, 1984, the disclosure of which is hereby incorporated by refrence, includes three substantially identical poles which are carried by a molded insulated housing 12. Each pole includes a terminal strap 14 which is integrally or brazenly connected to a first electrically conductive contact blade 16 which is affixed to the housing. The affixed contact blade has a generally U-shape with a contact carrying portion 13 which extends back toward the terminal strap 14. A contact 20 is carried at the end of the fixed contact blade 16. A movable contact 22 is carried by a movable contact blade 24 which is operably associated with a crossbar 26. The movable contact blade 24 is movable between a first position in which contacts 20 and 22 are engaged in a closed position and a second position in which contacts 20 and 22 are separated to an open position. The movable contact blade is electrically connected to the opposite terminal strap 30 of the circuit breaker.

A trip mechanism generally indicated by 28 includes means for opening the contacts by rotation of a trip bar 29 in response to sufficient overcurrent conditions.

Figure 4:
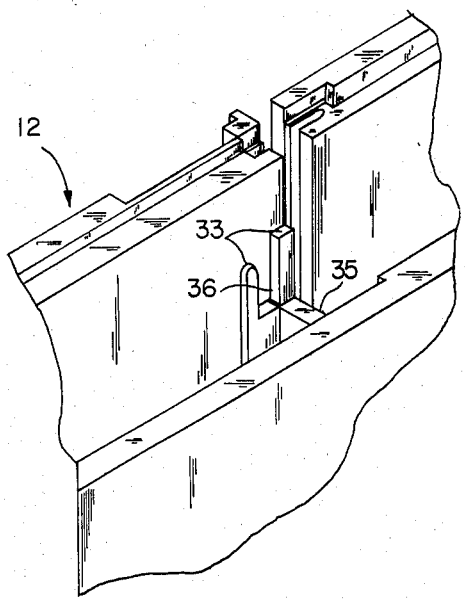
FIG. 4 is a partial perspective view showing the groove within the circuit breaker housing which retains the blade catcher assembly.

The blade catcher or anti-rebound module 32 is supported on a rubber support 34 which is connected to the top of a wall 35. The module is retained in groove 36 that is formed between a pair of ribs 33 within housing 12 as seen in FIG. 4 of the Drawings. Similar supports may be placed between the top of the module and the molded casing top of the circuit breaker.

Figure 2A:
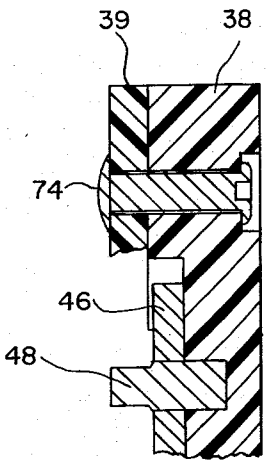
FIG. 2*a* is an enlarged partial side view showing the pin within the base about which the driver arm pivots.
Figure 2:
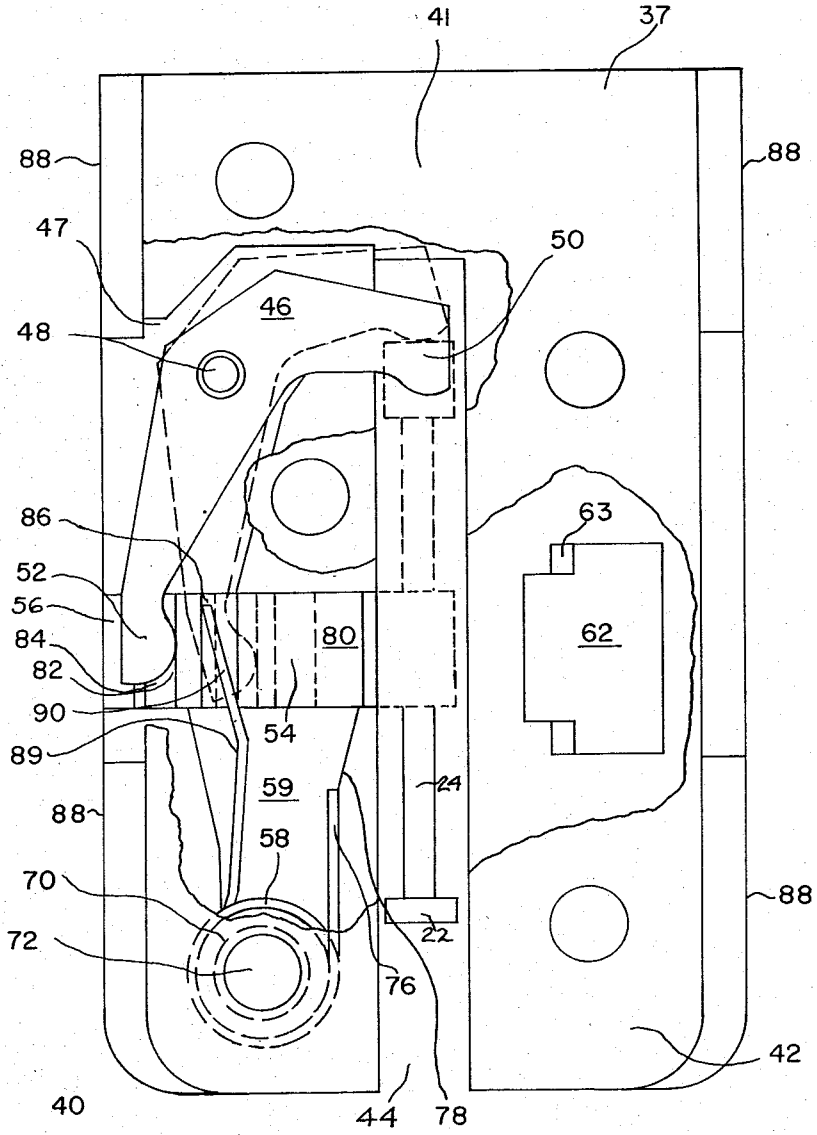
FIG. 2 is a front sectional view of the blade catcher assembly and associated blade in a closed position and showing, in phantom, the movement of the blade catcher in response to blow-open movement of the blade.
Figure 3:
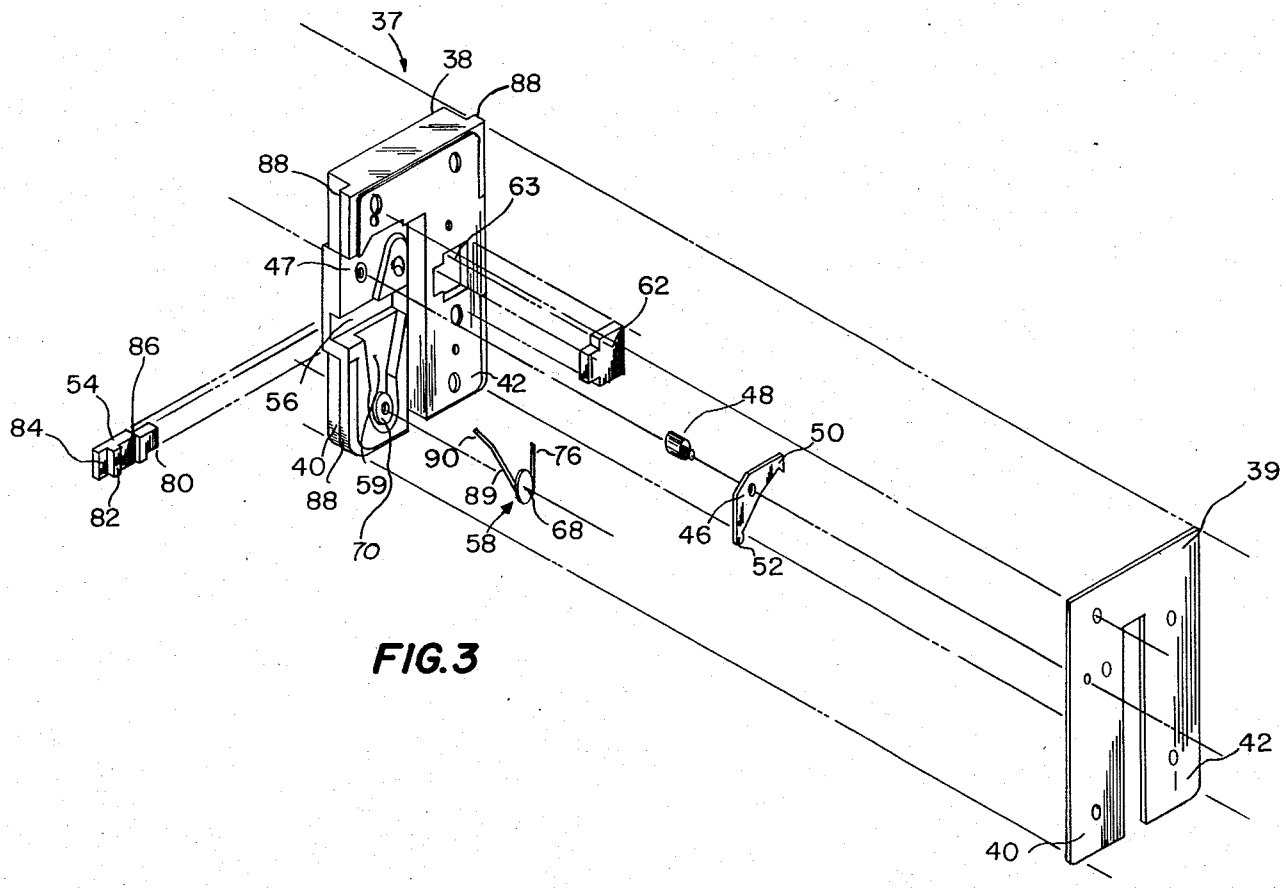
FIG. 3 is an exploded perspective view showing the blade catcher assembly.

As shown in FIGS. 2 and 3, the anti-rebound module 32 includes a generally U-shaped housing 37 which includes a back portion 38 and a cover portion 39. While many materials may be suitable, this embodiment includes a back portion formed from a polyester glass material and a cover portion formed of a melamine glass material. The back portion is molded to include recessed sections which receive the catcher mechanism as will later be described. The housing 37 has a pair of opposite side leg portions 40 and 42 connected by a base 41 with an intermediate blade path opening 44 between the side legs. The housing pivotally supports a drive-arm 46 in an upper recessed section 47 of the back portion. The drive arm is connected to the housing by a pivot pin 48 which is also shown in FIG. *2a*. The bottom of the pin is received in a recess in the back portion of the housing while a reduced diameter top portion of the pin is received in an opening in the cover of the housing. The drive arm, which may be formed from a hardened nickel plated AISI 1074 steel, is crescent shaped with a kicker portion 50 which extends into the blade path opening at the very top portion thereof. At the opposite end of the drive arm is a pusher portion 52 which extends downward along the outer portion of side leg 40 of the housing. A blade catcher 54 is retained within a central recessed channel 56 in the back portion of the housing. The blade catcher 54 is reciprocally movable within the channel 56 between a first position in which no portion of the blade catcher extends into the blade path opening 44 and a second position in which the blade catcher extends from one side leg 40 to the opposite side leg 42. The blade catcher is a generally rectangular metallic piece which can be formed of nickel plated cold rolled steel and includes an extending blade retaining portion 80 on one side which is stepped up slightly from the bottom surface of the blade catcher and a pusher surface 82 on the opposite side which receives the driving force of the drive arm. Extending outward from the pusher surface is a lateral catcher portion 84 which is stepped down from the top surface of the blade catcher and engaged with a side surface of the drive arm as shown in FIG. 2. Intermediate the retaining portion and the pusher surface is a spring channel 86.

A return spring 58 which is received in a lower recessed section 59 in the back portion of the housing urges the blade catcher 54 to its first position engaging the pusher surface 82 of the blade catcher with pusher portion 52 of the drive-arm 46. The opposite side leg 42 of the housing supports a catcher pole 62 which is supported directly across from the blade catcher in a recessed area 63 of the back portion. The catcher pole 62 may be formed from a nickel plated cold rolled steel which, although spaced away from the inner edge of the housing leg, provides a magnetic attraction for the metallic blade catcher 54 in response to the blow-open movement of the movable contact blade 24.

The return spring includes a coil portion 68 which receives a plug 70 formed in the housing base. The plug is provided with a central opening 72 through which a connecting rivet 74 extends. Several other rivets 74 connect the cover portion to the back portion of the housing. A first leg 76 of the spring is engaged with an inside wall 78 of the back portion of the housing forming a part of the lower recessed section 59. A second leg 89 of the spring is provided with a bent distal portion 90 which is received within the channel 86.

The housing is provided with a central side rib 88 at both the top and bottom of the outer side of each leg portion. Each side rib 88 is received in a groove 36 as shown in FIG. 4 in the lower portion of the circuit breaker housing 12 and corresponding grooves in a cover portion (not shown) of the circuit breaker housing.

When the circuit breaker is in the ON position, the return spring biases the blade catcher toward its first position and in engagement with the pusher portion of the drive-arm. The kicker portion 50 of the drive-arm extends into the top portion of the blade path opening. Upon an extreme overcurrent condition, the blade 24 blows open and travels through a path at a very high velocity through the blade path opening until it kicks the kicker portion 50 of the drive-arm thereby pivoting the drive-arm about pivot pin 48 causing the pusher portion 52 to immediately move the blade catcher against the bias of the spring 58 to a position approximately halfway towards the opposite or second side leg 42. The momentum of the blade catcher continues to carry it across to the opposite side leg. In the meantime, electromagnetic effects of the current through the blade cause an attraction between the blade catcher and the catcher pole 62, drawing the blade catcher all the way across the blade path opening and into engagement with the opposite leg 42 of the housing. The electromagnetic attraction between the catcher pole and the blade catcher will assist in retaining the blade catcher in a position to block the returning contact blade from rebounding to the stationary contact. It is possible that the blade catcher could also be retained in an appropriate position by striking an absorbant surface on the second side leg which would dampen rebound movement of the blade catcher. The underside of rebounding contact blade 24 hits the blade catcher 54 on its way downward and retains the blade catcher from being drawn back by the spring as a result of the friction between the blade and the blade catcher member, thereby providing sufficient time for the trip mechanism to trip and retain the blade in the open position. At this time, the spring automatically returns the blade catcher to its initial position permitting the breaker to be closed.

While the invention has particularly been shown and described with reference to a preferred embodiment, it will be understood by those skilled in the art that variations in form, construction and arrangements may be made therein without departing from the spirit and scope of the ivention. All such variations are intended to be covered in the appended claims.

What we claim is:

1. An anti-rebound latch assembly for controlling rebound movement of a blade which is movable through a defined path, said assembly comprising:

a housing having a first side leg, a second side leg and an opening between said first side leg and said second side leg to accommodate movement of said blade through said path;

a drive arm pivotally connected to said housing, said drive arm having a kicker portion extending into said opening and a pusher portion at its opposite end;

a blade catcher carried by said first side leg for reciprocal movement between a first position not extending into said opening and a second position extending across said opening; and a spring biasinng said blade catcher toward said first position.

2. An anti-rebound latch as claimed in claim 1 including a metallic catcher pole carried by said second leg opposite said blade catcher.

3. An anti-rebound latch assembly as claimed in claim 2 wherein said housing comprises a generally U-shaped back portion and a generally U-shaped cover portion, said back portion including recessed areas receiving said drive arm, said blade catcher, said spring and said catcher pole, and fastening means connecting said back portion to said cover portion.

4. An anti-rebound latch assembly as claimed in claim 3 wherein said back portion is formed from a polyester glass material and said cover portion is formed from an melamine glass material.

5. An anti-rebound latch assembly as claimed in claim 4 wherein said drive arm is generally crescent shaped.

6. An anti-rebound latch assembly as claimed in claim 5 wherein said spring comprises a central coil portion, a first leg extending from one end of said coil and engaged with said housing and a second leg extending from the opposite end of said coil, said blade catcher including a channel, said second leg of said spring received within said channel.

7. An anti-rebound latch assembly as claimed in claim 6 wherein said channel is partially defined by a first wall and a second wall facing and generally parallel to said first wall, said second leg of said spring including a bent distal portion received in a transverse direction within said channel.

8. A self contained modular anti-rebound latch assembly for controlling rebound movement of a blade which is movable through a defined path from a contact closed position to a contact open position in response to blow open forces, said assembly comprising:

a generally U-shaped housing having a first side leg;

a second side leg spaced from said first side leg to provide an opening therebetween, and a base connecting said first side leg to said second side leg;

said blade extending through said opening in a generally perpendicular relationship with said housing adjacent the end of the housing opposite from the base in response to said blade assuming said closed position;

a drive-arm pivotally carried by said housing, said drive-arm having a kicker portion extending into said opening adjacent said base and a pusher portion at its opposite end;

a blade catcher carried by said first side leg for reciprocal movement between a first position not protruding into said opening and a second position extending across said opening to said second side leg;

biasing means for biasing said blade catcher toward said first position; and pole means carried by said second leg for attracting said blade catcher in response to said blade moving from said closed position to said open position causing said drive arm to drive said blade catcher towards said second position.

9. An anti-rebound latch assembly as claimed in claim 8 wherein said biasing means comprises a coil spring.

10. An anti-rebound latch assembly as claimed in claim 9 wherein said housing comprises a generally U-shaped back portion and a generally U-shaped cover portion, said back portion including recessed areas receiving said drive arm;

said blade catcher, said spring and said pole means, and fastening means connecting said back portion to said cover portion.

11. An anti-rebound latch assembly as claimed in claim 10 wherein said blade catcher comprises a generally rectangular metallic piece having a top surface and a bottom surface and a blade retaining portion raised slightly from said bottom surface.

12. An anti-rebound latch assembly as claimed in claim 11 wherein said blade catcher includes a pusher surface on the opposite side of said back retaining portion, said pusher portion including a curvilinear contact surface engagable with said pusher surface for moving said blade catcher from said first position toward said second position in response to pivotal movement of said drive arm caused by the blow open movement of said blade.

13. An automatic electric circuit breaker having blow-open current limiting design comprising:

an insulated circuit breaker housing;

a line terminal;

a load terminal;

a pair of separable contacts, at least one of which is carried by a movable contact blade; said contact blade being movable through a path to a blow-open position in response to a predetermined overcurrent condition;

trip means for mechanically moving said contact blade to an open position in which said contacts are separated; and a self contained modular mechanically and electromagnetically operated anti-rebound latch means for controlling the rebound movement of said blade from said blow-open position to prevent the closing of said contact prior to operation of said trip means to retain said contacts in a separated position, said latch means including a housing; a blade catcher carried by said housing and reciprocally movable between a first position outside said path and a second position within said path; and biasing means for continuously biasing said catcher toward said first position.

14. A circuit breaker as claimed in claim 13 wherein said latch means is contained within a generally U-shaped housing, said housing provided with rib portions on each side;

said circuit breaker housing provided with a pair of opposite grooves receiving said rib portions.

15. A self contained modular anti-rebound latch assembly for controlling rebound movement of a blade which is movable through a defined path from a contact closed position to a contact open position in response to blow open forces, said assembly comprising:

a generally U-shaped housing having a first side leg;

a second side leg spaced from said first side leg to provide an opening therebetween, and a base connecting said first side leg to said second side leg;

said blade extending through said opening in a generally perpendicular relationship with said housing adjacent the end of the housing opposite from the base in response to said blade assuming said closed position;

a drive-arm pivotally carried by said housing, said drive-arm having a kicker portion extending into said opening adjacent said base and a pusher portion at its opposite end;

a blade catcher carried by said first side leg for reciprocal movement between a first position not protruding into said opening and a second position extending across said opening to said second side leg;

biasing means for biasing said blade catcher toward said first position; and delay means for delaying return movement of said blade catcher from said second position to said first position.

* * * * *